United States Patent [19]

Sadoway

[11] Patent Number: 4,999,097

[45] Date of Patent: Mar. 12, 1991

[54] APPARATUS AND METHOD FOR THE ELECTROLYTIC PRODUCTION OF METALS

[75] Inventor: Donald R. Sadoway, Belmont, Mass.

[73] Assignee: Massachusetts Institute of Technology, Cambridge, Mass.

[21] Appl. No.: 383,321

[22] Filed: Jul. 20, 1989

Related U.S. Application Data

[63] Continuation-in-part of Ser. No. 255,099, Jul. 28, 1988, abandoned, which is a continuation-in-part of Ser. No. 657, Jan. 6, 1987, abandoned.

[51] Int. Cl.[5] ..... C25C 3/08

[52] U.S. Cl. ..... 204/243 R; 204/279; 204/290 R; 204/292; 204/291; 204/292; 204/293

[58] Field of Search ..... 204/67, 243 R, 291, 204/279, 290 R, 293

[56] References Cited

U.S. PATENT DOCUMENTS

| | | | |
|---|---|---|---|
| 3,093,570 | 6/1983 | Dewey | 204/243 |
| 3,433,749 | 3/1969 | Nishimoto et al. | 252/521 |
| 4,039,410 | 8/1977 | Yamada et al. | 204/67 |
| 4,057,480 | 11/1977 | Alder | 204/290 R |
| 4,173,518 | 11/1979 | Yamada et al. | 204/67 |
| 4,187,155 | 2/1980 | de Nora et al. | 204/67 |
| 4,504,369 | 3/1905 | Keller | 204/67 |
| 4,650,552 | 3/1987 | de Nora et al. | 204/67 |
| 4,680,094 | 7/1987 | Duruz | 204/67 |

FOREIGN PATENT DOCUMENTS

| | | |
|---|---|---|
| 192603 | 8/1986 | European Pat. Off. . |
| WO84/02724 | 7/1984 | PCT Int'l Appl. . |
| WO88/01313 | 2/1988 | PCT Int'l Appl. . |

OTHER PUBLICATIONS

McLeod et al., *Light Metals*, TSM-AIME, 357-365 (1987).

*Primary Examiner*—John F. Niebling
*Assistant Examiner*—Kathryn Grogos
*Attorney, Agent, or Firm*—Wolf, Greenfield & Sacks

[57] ABSTRACT

Improved electrolytic cells and methods for producing metals by electrolytic reduction of a compound dissolved in a molten electrolyte are disclosed. In the improved cells and methods, a protective surface layer is formed upon at least one electrode in the electrolytic reduction cell and, optionally, upon the lining of the cell. This protective surface layer comprises a material that, at the operating conditions of the cell: (a) is not substantially reduced by the metal product; (b) is not substantially reactive with the cell electrolyte to form materials that are reactive with the metal product; and, (c) has an electrochemical potential that is more electronegative than that of the compound undergoing electrolysis to produce the metal product of the cell. The protective surface layer can be formed upon an electrode metal layer comprising a material, the oxide of which also satisfies the protective layer selection criteria. The protective layer material can also be used on the surface of a cell lining.

31 Claims, 5 Drawing Sheets

APPARATUS AND METHOD FOR THE ELECTROLYTIC PRODUCTION OF METALS

GOVERNMENT SUPPORT

Work described herein was supported in part by a grant from the U.S. Department of Energy.

This application is a continuation-in-part of U.S. patent application Ser. No. 07/225,099 filed July 28, 1988, now abandoned, which, in turn, is a continuation-in-part of U.S. patent application Ser. No. 07/000,657, filed Jan. 6, 1987, now abandoned.

BACKGROUND OF THE INVENTION

A variety of metals having significant industrial uses are not found naturally in their elemental forms. Rather, these metals are mined as a variety of compounds from which the desirable metal product must be extracted. One such metal is aluminum. Commercially, aluminum is produced from naturally occurring aluminum compounds by the electrolytic reduction of alumina $Al_2O_3$. Alumina is obtained from bauxite ore by the Bayer process which involves digesting crushed bauxite ore in strong caustic soda solution.

In 1886, Charles Hall in the United States and Paul Heroult in France independently developed the currently employed electrolytic process for extracting aluminum from alumina. This process, known today as the Hall-Heroult process, transformed aluminum from a precious metal into a common structural material. The process is still the most widely used commercial process for obtaining aluminum metal and is fundamentally the same as it was originally disclosed by Hall and Heroult in 1886.

In the Hall-Heroult process, electric current is passed through molten electrolyte containing alumina. An important feature of the Hall-Heroult discovery was that cryolite, a double salt of aluminum and sodium, represented by the chemical formula, $Na_3AlF_6$, would dissolve alumina at temperatures around 1000° C. and that the dissolved alumina could be electrolytically reduced to form molten aluminum metal.

The electrolytic reduction of metals is often performed in large cells or pots. These cells typically have massive carbon cathodes at the base and carbon anodes, normally formed in the shape of large blocks, suspended above the cell and capable of being lowered into the electrolyte. Direct electric current is passed from the anodes through the electrolyte to the carbon cathodes. During the reduction of alumina, for example, the carbon anodes are consumed in the chemical reaction occurring in the cell. This reaction can be represented, as follows:

$$2Al_2O_3+3C \rightarrow 4Al+3CO_2.$$

This process yields an aluminum product that is very pure, e.g., 99.0% to 99.8%. The main impurities are traces of iron and silicon.

Despite its capability to produce high purity aluminum, the Hall-Heroult process has always suffered a number of significant problems. The most important of these arises from the use of consumable carbon anodes. These anodes are expensive to produce, and this cost adds significantly to the overall cost of aluminum produced by the Hall-Heroult process. Furthermore, it is difficult to maintain uniform anode current loading during use since the anodes are consumed resulting in a continuous change in their shape.

Because of the problems associated with carbon anodes, substantial research has been conducted in an effort to find another anode material, particularly what has been referred to as a non-consumable anode. Such an anode does not react with oxygen formed at the anode, does not dissolve in the electrolyte and is not consumed in the electrolytic reaction. Unfortunately, the research conducted to date has not resulted in the development of a fully satisfactory anode material.

Another set of problems with electrolytic reduction cells arises from the use of a carbon lining in the cell. These cells are operated under conditions that cause molten electrolyte to freeze on the sidewalls of cells during operation so that molten electrolyte floating on molten metal product is contained within a shell of frozen electrolyte. This is necessary to prevent reaction between the carbon cell lining and constituents of the molten electrolyte during operation of these cells. The position of the interface between the frozen and molten electrolyte changes, however, during operation of cells, making it difficult to establish uniform operating conditions. Also, the maintenance of frozen electrolyte at the sidewalls results in a substantial heat loss from the cell which in turn reduces its thermal efficiency.

A third set of problems associated with electrolytic reduction cells arises from the lack of a suitable cathode material. Presently, carbon is used as the cathode material in these cells. Unfortunately, a product such as molten aluminum does not wet carbon. Therefore, in the case of aluminum production, it is necessary to maintain a deep pool of molten aluminum on the bottom of the cell. This is required because the carbon cathode surface must be fully covered in order to prevent contact between the molten salt electrolyte and the cathode itself in the presence of molten aluminum. Otherwise, the formation of aluminum carbide occurs, and this both reduces the productivity of the cell and consumes the carbon cathode.

The presence of the deep pool, however, creates a new problem. The cell currents are generally extremely high, typically on the order of about 100 kA to about 300 kA. At such currents, electromagnetic forces can cause the molten aluminum to develop waves of substantial physical dimension. To prevent electrical shorting of the molten aluminum to the anode, allowance must be made in the separation of the anode and cathode. This results in an excessive voltage drop across the electrolyte and contributes to poor energy utilization within the cells.

Problems such as those discussed above for Hall-Heroult cells also exist with other electrolytic cells and processes for the electrolytic production of metals from oxide based feed materials. This has in many instances, resulted in the metals being produced from more expensive feed materials or by use of more complicated and expensive processes than would be required if oxide based feed materials could be used.

As such, a need exists for electrodes and cell linings in electrolytic cells used for the reduction of oxide based feed materials that are not consumed under the operating conditions of the cell, allow closer anode/cathode spacing, and can be shaped to electrode and cell lining configurations that are thermally and mechanically stable.

SUMMARY OF THE INVENTION

This invention relates to the discovery that material structures heretofore not considered useful in anodes, cathodes and cell linings of cells for the electrolytic production of metals from oxide based feed materials can be employed to provide improved electrolytic cells and processes for the electrolytic production of metals. In a preferred embodiment, the invention pertains to electrode and sidewall structures useful in Hall-Heroult cells for the electrolytic production of aluminum from aluminum oxide.

For the improved anodes, cell linings and cathodes of this invention, all surfaces which contact electrolyte in the cell are formed of a material selected such that, under the operating conditions of the cell, such material: (a) is not substantially reduced by the elemental metal product; (b) is not substantially reactive with the electrolyte contained in the cell to form materials that are reactive with the elemental metal product; and (c) has an electrochemical potential that is more electronegative than that of the oxide based feed material undergoing electrolysis in order to produce the elemental metal product. The protective surface material is preferably in the form of a protective surface layer. Additionally, the materials forming the surface layer upon the electrodes and the cell lining must be thermally and mechanically stable under the operating conditions of the cell.

For one embodiment of the invention, electrolyte contained within the cell is first saturated with the materials that form the protective layer. Such a saturation prevents consumption of the anode and cell lining during cell operation. The saturation can be accomplished by running the cell for a sufficient period to saturate the electrolyte with materials that migrate from the layer into the electrolyte or, preferably, by constituting the electrolyte so as to include a sufficient amount of the materials to saturate the electrolyte prior to cell operation. In another embodiment, the protective layer can be formed of a material that is insoluble in the electrolyte. In this embodiment, no saturation of the electrolyte with protective layer material is necessary, as the material cannot dissolve in the electrolyte.

The use of materials meeting the criteria as a protective layer for the electrodes and the cell lining of an electrolytic cell results in significant advantages over the use of pre-baked carbon electrodes and carbon cell linings currently employed. For example, once the electrolyte is saturated with material meeting these criteria, the anode and cell lining become effectively non-consumable since the materials form a protective surface layer that neither co-deposits with nor is chemically displaced by the metal product to any significant extent. The anodes retain their shape thereby facilitating the maintenance of uniform current density in the electrolytic cell. Further, the problems encountered in maintaining proper anode/cathode spacing with consumable carbon electrodes are reduced. In addition, anodes having a protective surface layer obviate one of the major reasons necessitating the use of anode/cathode spacings greater than required which results in inordinate consumption of electrical energy. Thus, anodes having a protective surface layer allow greater flexibility in the choice of operating conditions for the electrolytic cells.

The electrodes as described herein will also allow significant reductions in capital investment for the production of metals because they eliminate the need for expensive pre-baked carbon electrodes as well as the expensive baking facilities required to produce these carbon electrodes. Instead, the protective materials meeting the selection criteria described above are readily available or can be readily formed upon the electrodes or cell linings formed of less expensive, commodity materials. In addition, the anodes do not have to be replaced as frequently since they are essentially non-consumable. This reduces operating costs, as anode changes are labor intensive and result in significant cell down time.

The use of protective surface layer materials in the cell lining eliminates the need to maintain the walls of the cell sufficiently cool to freeze molten electrolyte. Indeed, the ability to insulate the walls of the electrolytic cell so that they are maintained in a hot, ledge-free condition should result in significant thermal energy savings. Additionally, ledge-free sidewall operation gives greater latitude in cell operating conditions. For example, operation at a high current density generates Joule heat in excess of that which can be extracted through the frozen sidewall. With a ledge-free sidewall, however, the thermal management of the cell is so much improved that the cell can be operated at a much higher current density ceiling, thereby greatly increasing cell productivity at a fixed or near-fixed capital cost.

Running the electrolytic cells under conditions where the electrolyte is saturated with materials satisfying the criteria described herein also provides significant advantages over traditional operating conditions. For example, the use of certain of these materials may decrease the melting point of the electrolyte and thus will provide a number of advantages associated with the capability to run the cells at lower operating temperatures, such as a reduced heat load. The use of other materials may change the density of the electrolyte so as to cause the molten aluminum product to float rather than sink. In such cases, operation of the cells at higher alumina concentrations, i.e. near saturation, is facilitated, thereby improving the yield of the process by increasing the limiting current density which is directly proportional to the alumina concentration of the electrolyte.

BRIEF DESCRIPTION OF THE FIGURES

FIG. 2(*b*) is a flow chart that illustrates the method for selecting suitable protective surface layer materials for the cell lining and cathode of an electrolytic reduction cell.

DETAILED DESCRIPTION OF THE INVENTION

Although the present invention is intended to apply to all cells useful for the electrolytic reduction of metals from oxide-based feed materials, cells and processes for the production of aluminum are described in detail herein for the purpose of illustration. The invention, however, is not intended to be limited solely to aluminum production cells and processes.

Figure 1:
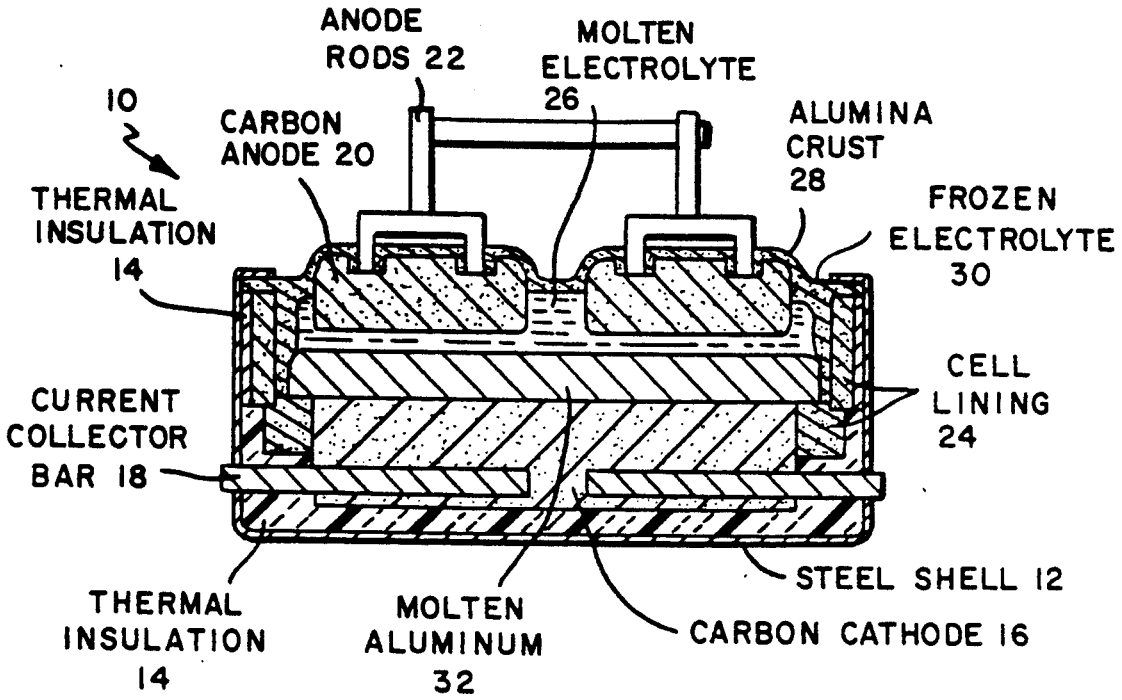
FIG. 1 PRIOR ART
FIG. 1 is a schematic illustration of a Hall-Heroult cell of the type commonly employed in the commercial production of aluminum.

A conventional Hall-Heroult cell 10 employing pre-baked carbon anodes is illustrated schematically in FIG. 1. This cell has a steel outer shell 12 with thermal insulation 14 on the inside of shell 12. A carbon cathode 16 is positioned at the bottom of cell 10 and contains metallic current collector bars 18. Carbon anodes 20 are formed from pre-baked carbon blocks suspended from steel anode rods 22 which serve to supply electrical current to anodes 20. Cell lining 24 is also formed from carbon blocks.

Molten electrolyte 26 contains dissolved alumina supplied by breaking alumina crust 28 and adding fresh alumina. Crust 28 forms on frozen electrolyte and helps to minimize heat loss from the top of cell 10. Cryolite, $Na_3AlF_6$, is commonly employed as the principal constituent of the electrolyte since it dissolves alumina at temperatures around 1000° C. In addition, certain fluoride salts, such as aluminum fluoride, $AlF_3$, and calcium fluoride, $CaF_2$, are also present in the electrolyte. $AlF_3$ and $CaF_2$ decrease the freezing point of electrolyte and $AlF_3$ also improves current efficiency in the cell.

As electric current is passed from carbon anode 20 through molten electrolyte 26 to cathode 16, dissolved alumina is reduced to form molten aluminum layer 32 at the bottom of the Hall-Heroult cell and gas consisting of carbon dioxide and carbon monoxide is generated at the anode. Carbon anode 20 is consumed during this reaction in the approximate amount about ½ lb. of anode per lb. of aluminum product.

It is important to prevent molten electrolyte 26 from contacting carbon cell lining 24 to prevent cell lining failure caused by the formation of intercalation compounds and the formation and dissolution of $Al_4C_3$. To prevent such contact, cell 10 is operated under conditions that cause a layer of frozen electrolyte 30 to form between carbon cell lining 24 and molten electrolyte 26. Thus, molten electrolyte 26 is contained in a shell of frozen electrolyte and supported by a pad of molten aluminum 30. Unfortunately, during operation of the Hall-Heroult cell, the location of interface between molten and frozen electrolyte varies depending upon operating conditions. This adds to the difficulty in operating the cell under uniform conditions.

Molten aluminum 30 does not wet the carbon cathode 16. Unfortunately, electrodeposition of aluminum directly on carbon permits the formation of aluminum carbide, $Al_4C_3$, which is soluble in the electrolyte. Such formation of aluminum carbide and its subsequent dissolution in the electrolyte consumes the carbon cathode and, hence, must be prevented. In practice, this is accomplished by covering the carbon cathode with a deep pool of molten aluminum. In this way, aluminum deposits onto molten aluminum rather than onto carbon. Furthermore, any aluminum carbide that forms at the interface between the aluminum pool and the carbon cathode must diffuse across the deep aluminum pool in order to dissolve in the electrolyte. However, there are disadvantages with this arrangement. The dimensional instabilities inherent in such a deep cathode pool of aluminum through which large electrical currents are passed require excessive spacing between the anode and cathode with all attendant disadvantages in order to prevent the dimensionally unstable aluminum pool from contacting the anode and electrically shorting the cell.

As mentioned above, there has been much effort directed toward finding replacement materials for the carbon electrodes and carbon cell lining of a conventional Hall-Heroult cell. Much of this research has been directed to finding inert anode materials, however, a material that is entirely satisfactory has not been previously identified.

The present invention results from the discovery that certain materials, that may be soluble to some extent in the molten electrolytes employed in electrolytic reduction cells, can be employed as the surface, and preferably as protective surface layers upon, the anode, cathode and cell lining of these cells. The protective surface layer materials of this invention are carefully selected so that, despite any solubility in the electrolyte, there is no net consumption of these materials, and their presence in the electrolyte does not result in contamination of the reduced metal product.

A first criterion for materials suitable for use as a protective surface layer upon electrodes or cell linings according to this invention is that the candidate material must not be substantially reduced by the elemental metal being produced. In the case of aluminum, a variety of oxygen-bearing metal compounds, termed "metal oxides" herein, satisfy this requirement. It should be noted that the term "metal oxide" is used generically herein to mean any reaction product containing the metal, provided that the formation reaction involves a chemical oxidation, i.e. an increase in metal valence.

The reaction between the candidate metal oxide and elemental aluminum likely occurs at the anode surface. Such a reaction between the anode and the dissolved elemental aluminum is represented by the following reaction:

$$MeO_{n/2} + \frac{n}{3}\,Al \rightarrow \frac{n}{6}\,Al_2O_3 + Me \qquad (1)$$

wherein Me represents the metallic element in the candidate metal oxide and n is the valence of the metal in the metal oxide compound. At the operating temperature of a Hall Cell, the candidate metal oxide must be more stable than aluminum oxide. Otherwise, the candidate metal oxide will be reduced and the anode protective layer will be consumed.

The free energy change for reaction (1) calculated per mole of metal, Me, at about 1300K for convenience, is given for various oxides in Table I, below.

TABLE I

Free Energy of Reaction for Metal-Oxide Exchange at 1300K

| OXIDE | $\Delta G^{\circ}_1$ (kJ) | OXIDE | $\Delta G^{\circ}_1$ (kJ) | OXIDE | $\Delta G^{\circ}_1$ (kJ) |
|---|---|---|---|---|---|
| $PbO_2$ | −829 | $Ta_2O_5$ | −303 | $CeO_2$ | −19 |
| $WO_3$ | −733 | NiO | −301 | Tio | −3 |
| $Rh_2$ | −613 | CdO | −295 | BaO | 0 |
| $SbO_2$ | −609 | CoO | −284 | $Li_2O$ | 3 |
| $SnO_2$ | −528 | FeO | −233 | $ZrO_2$ | 14 |
| $Bi_2O_3$ | −522 | $Cr_2O_3$ | −231 | $UO_2$ | 21 |
| $V_2O_5$ | −521 | ZnO | −229 | $HfO_2$ | 37 |
| $GeO_2$ | −507 | $Cu_2O$ | −184 | MgO | 38 |
| $WO_2$ | −482 | $V_2O_3$ | −181 | BeO | 51 |
| $Sb_2O_3$ | −448 | $K_2O$ | −165 | SrO | 54 |
| CuO | −385 | $SiO_2$ | −150 | CaO | 79 |

TABLE I-continued

Free Energy of Reaction for Metal-Oxide Exchange at 1300K

| OXIDE | $\Delta G^{\circ}_1$ (kJ) | OXIDE | $\Delta G^{\circ}_1$ (kJ) | OXIDE | $\Delta G^{\circ}_1$ (kJ) |
|---|---|---|---|---|---|
| $Fe_2O_3$ | −384 | $B_2O_3$ | −145 | $La_2O_3$ | 81 |
| $Nb_2O_5$ | −370 | MnO | −139 | $Nd_2O_3$ | 89 |
| PbO | −347 | $TiO_2$ | −130 | $Sm_2O_3$ | 93 |
| $VO_2$ | −330 | $Na_2O$ | −124 | $Ce_2O_3$ | 99 |
| $Mn_2O_3$ | −321 | VO | −108 | $Sc_2O_3$ | 133 |
| $Ga_2O_3$ | −304 | $Ti_2O_3$ | −48 | $Y_2O_3$ | 133 |
| | | | | $ThO_2$ | 144 |

As can be seen by the Table, a series of oxides from $Li_2O$ to $ThO_2$ will satisfy the first criterion. Their positive $\Delta G^{\circ}$ indicates that dissoved aluminum will not substantially reduce the oxide on the assumption that the activities of the dissolved metals are unity.

Additionally, some materials that would not appear to satisfy the above criterion may still be used due to the so-called "shroud effect". During electrolysis the anode is surrounded by a "shroud" of $O_2$ which evolves at the inert anode. The oxygen reacts with dissolved elemental aluminum in the electrolyte to form aluminum oxide which itself dissolves in the electrolyte. This has the effect of reducing the amount of dissolved elemental aluminum in the electrolyte next to the anode. At high current densities, it is possible for the rate of aluminum oxidation to be high enough to prevent any dissolved metal from reaching the anode. In this situation, oxygen evolution can be viewed as providing a kinetic barrier to chemical attack of the anode by elemental aluminum.

A second criterion for selection of the protective surface layer material is that it does not substantially react with the cell electrolyte. Thus, in the Hall-Heroult cell, the protective surface layer must not react with aluminum fluoride as in the following reaction:

$$MeO_{n/2} + \frac{n}{3} AlF_3 \rightarrow MeF_n + \frac{n}{6} Al_2O_3 \quad (2)$$

wherein Me and n are as previously defined. If reaction (2) does occur, the protective surface layer will be consumed. While the propensity for reaction by equation (2) is very difficult to assess on the basis of thermodynamic data alone, suitable materials can be identified through experimentation. Among those materials found to be stable when exposed to aluminum fluoride at Hall cell operating conditions, $ZrO_2$ is currently preferred. However, other materials, such as $HfO_2$, $ThO_2$ and $UO_2$, also satisfy the first two selection criteria.

Additionally, even if a metal oxide candidate were found to undergo the reaction described as equation (2), the material still could serve as a satisfactory protective surface layer material if the metallic fluoride were not subject to a reaction with the product metal as shown in the reaction below:

$$MeF_n + \frac{n}{3} Al \rightarrow \frac{n}{3} AlF_3 + Me \quad (3)$$

wherein Me and n are as previously described. Thus, in the example of the Hall-Heroult cell, even if a metal fluoride forms, if it does not substantially react with elemental aluminum, it is still acceptable with respect to the second criterion. On the other hand, if the metal fluoride is reactive with elemental aluminum, this will lead directly to chemical displacement of the metal from the electrolyte causing it to be deposited with the aluminum. Thus, while it is desirable that the candidate material resist dissolution through chemical attack by the electrolyte, this is not an absolute requirement. Rather, the requirement is that the candidate material must resist exsolution.

Therefore, to satisfy the second criterion for the case of aluminum production, the candidate metal oxide protective surface layer must not be substantially reactive with $AlF_3$. In the alternative, if the metal oxide does react with $AlF_3$, it must form a compound that readily saturates the electrolyte and is not attacked by elemental aluminum.

The third and final criterion is that the protective surface layer material must not be substantially co-deposited with the product metal by electrolytic reaction.

In the case of the Hall-Heroult cell, the capability of a metal oxide to co-deposit with aluminum can be determined using the calculated reversible decomposition potential, E°, at the cell operating temperature for the reaction, $$MeO_{\frac{n}{2}} \rightarrow Me + \frac{n}{2} O_2 \quad (4)$$

wherein Me represents the metallic element in the oxide compound under consideration and n is the valence of this metal in the oxide compound. This can be calculated using the equation:

$$E^{\circ} = -\frac{\Delta G^{\circ}}{nF} \quad (5)$$

where F is the Faraday constant and $\Delta G^{\circ}$ is the standard Gibbs free energy of reaction 4. Calculated values of E° are given in Table II which has been prepared for the temperature of 1300K.

TABLE II

Oxide Decomposition Potentials at 1300K

| OXIDE | −E° (V) | OXIDE | −E° (V) | OXIDE | −E° (V) |
|---|---|---|---|---|---|
| $PbO_2$ | 0.043 | FeO | 0.987 | $CeO_2$ | 2.130 |
| $Rh_2O_3$ | 0.054 | ZnO | 1.052 | TiO | 2.158 |
| CuO | 0.206 | $Mn_2O_3$ | 1.067 | $Al_2O_3$ | 2.179 |
| $Cu_2O$ | 0.380 | $V_2O_5$ | 1.069 | BaO | 2.179 |
| $Bi_2O_3$ | 0.409 | $Na_2O$ | 1.117 | $ZrO_2$ | 2.207 |
| PbO | 0.466 | $Ga_2O_3$ | 1.146 | $Li_2O$ | 2.208 |
| $SbO_2$ | 0.597 | $VO_2$ | 1.302 | $UO_2$ | 2.235 |
| NiO | 0.640 | $Cr_2O_3$ | 1.363 | $HfO_2$ | 2.274 |
| $Sb_2O_3$ | 0.647 | $Nb_2O_5$ | 1.386 | MgO | 2.376 |
| CdO | 0.705 | MnO | 1.486 | BeO | 2.445 |
| CoO | 0.727 | $Ta_2O_5$ | 1.529 | $La_2O_3$ | 2.457 |
| $K_2$ | 0.748 | $V_2O_3$ | 1.544 | SrO | 2.459 |
| $SnO_2$ | 0.813 | $B_2O_3$ | 1.638 | $Nd_2O_3$ | 2.484 |
| $Fe_2O_3$ | 0.842 | VO | 1.638 | $Sm_2O_3$ | 2.505 |
| $GeO_2$ | 0.846 | $SiO_2$ | 1.757 | $ThO_2$ | 2.549 |
| $WO_3$ | 0.879 | $TiO_2$ | 1.822 | CaO | 2.590 |
| $WO_2$ | 0.911 | $Ti_2O_3$ | 2.007 | $Ce_2O_3$ | 2.599 |
| | | | | $Sc_2O_3$ | 2.621 |
| | | | | $Y_2O_3$ | 2.643 |

According to these thermodynamic data, those oxides whose E° is more negative than that of $Al_2O_3$ will not co-deposit with aluminum. The calculation of equation 5 is based upon the assumption of unit activity of the metal. In fact, the metal's activity in molten aluminum is expected to be less than unity under conditions of co-deposition since the metal is in its elemental form only transiently, if at all, due to simultaneous alloying reaction with the molten aluminum. However, the magnitude of the cathodic shift in E° is only about 0.2 V for variations of metal activity in molten aluminum to values as low as 0.01. Furthermore, kinetic factors should not be significant on a liquid metal cathode. Thus, Table III is useful for all practical purposes.

Figure 2:
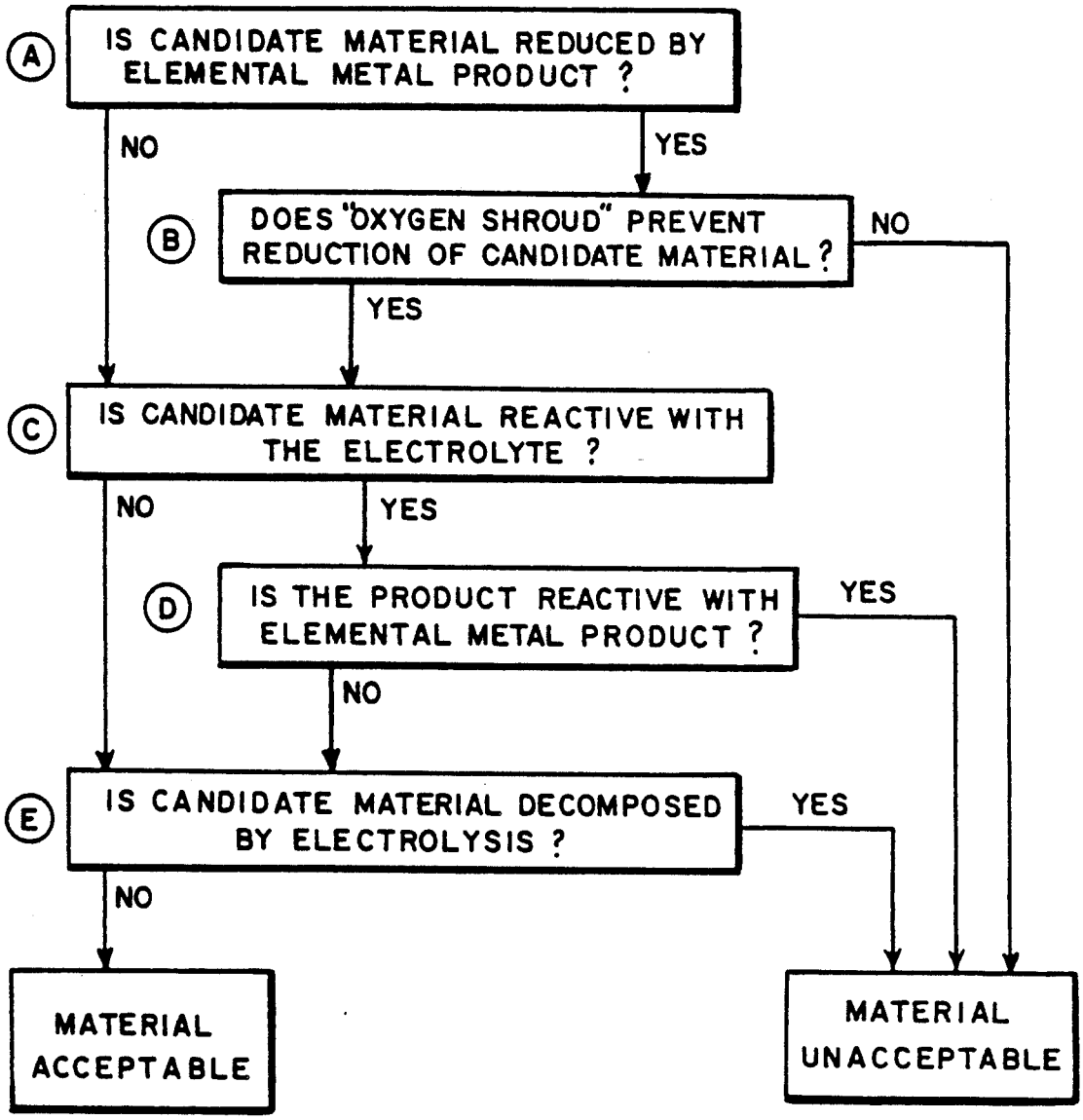
FIG. 2(*a*) is a flow chart that illustrates the method for selecting a suitable protective surface layer for an anode used in an electrolytic reduction cell.
Figure 2:
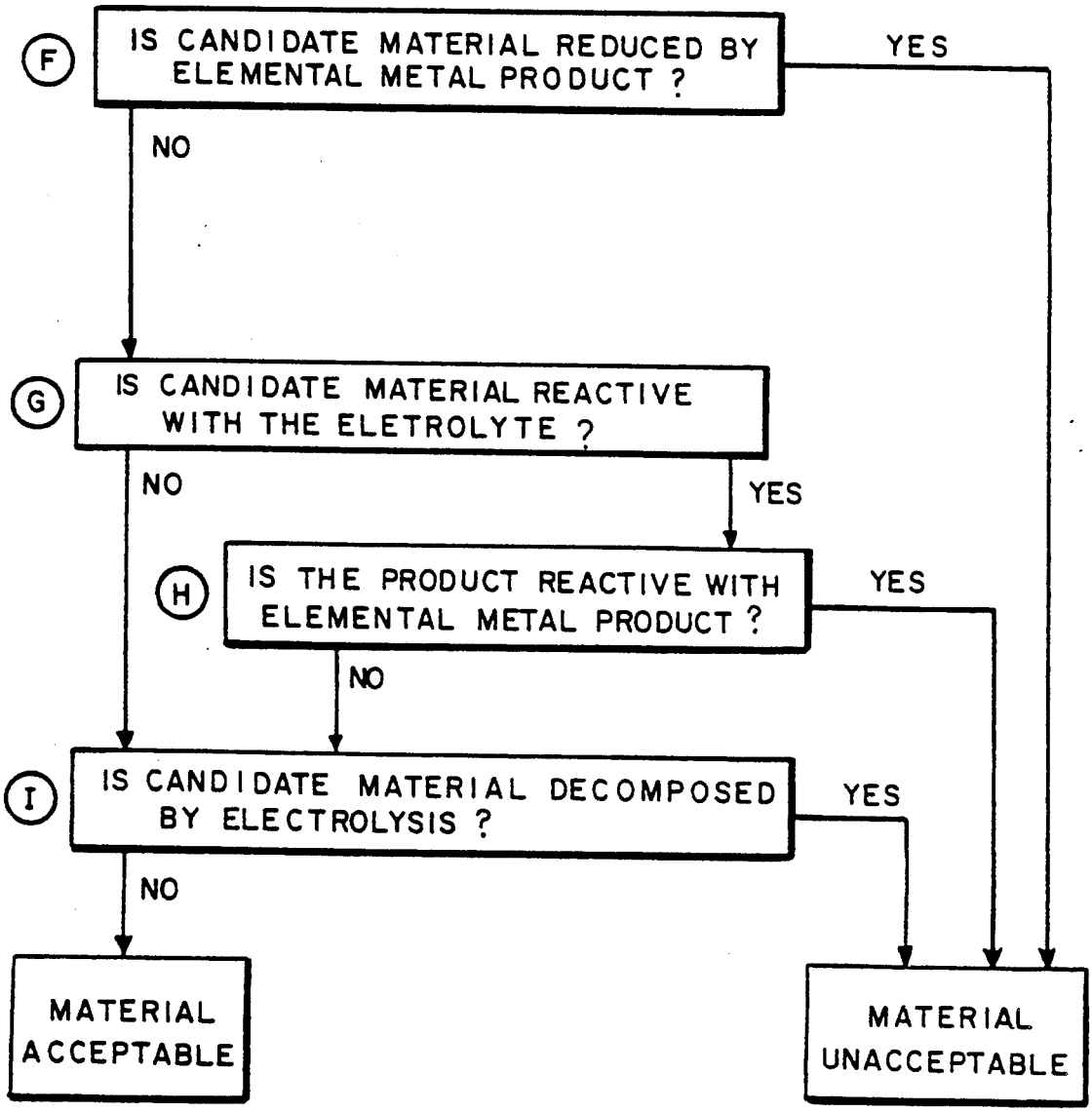

A flow chart teaching the use of the above criteria in selecting an anode protective surface layer material is presented in FIG. 2(*a*). According to the steps of material selection as outlined in FIG. 2(*a*), the following metal oxides have so far been found to be theoretically useful as anode coating materials in aluminum reduction cells: $ZrO_2$, $HfO_2$, $ThO_2$ and $UO_2$. Since, however, some forms of $UO_2$ are radioactive, uranium oxides are not considered especially practical for this application.

A determination for the use of non-oxide coating materials can be made in a manner similar to that described above for oxides.

Broadly, as represented in FIG. 2(*a*) by the boxes labeled A and B, the first criterion for selection of protective surface layer materials for molten salt electrolytic cell anodes according to this invention is that the candidate material must not be substantially reduced by the elemental metal being produced at the operating conditions of the cell. Box A covers the basic requirement that the candidate material not be reduced by the elemental metal, while box B covers a special case in which, at the operating conditions of the cell, materials that would normally be reduced by the metal are protected. The second criterion, represented by boxes C and D, is that the material must not substantially react with the electrolyte contained in the cell to form materials that are reactive with the elemental metal product at the operating conditions of the cell. If a candidate coating material is not reactive with the electrolyte as shown in box C, it satisfies the second criterion. Additionally, even if the coating material is reactive with the electrolyte, if the reaction product is not reactive with the elemental metal product, this coating material also satisfies the second criterion. This is represented by box D. The third criterion, represented by box E, is that the electrochemical potential of the protective surface layer material must be more electro-negative than that of the material being electrolyzed in the cell to make metal product, thereby preventing the protective surface layer material from being decomposed by electrolysis and then co-deposited with the metal product.

It is possible in some cases that minor amounts of metal from the anode coating material might co-deposit despite the fact that the anode material satisfies these criteria. This could be because electrolytic reduction cells do not operate under the exact equilibrium conditions for which the available thermodynamic data were generated. It is also possible that the available thermodynamic data employed in calculating the standard potential are not entirely accurate.

Selection criteria for protective surface layer materials on the cell lining and cathode are similar to those used for protective anode materials. The major difference is that no oxygen shroud surrounds the cell lining or cathode as is the case of the anode. Thus, in selecting suitable cell lining and cathode protective materials, one does not consider the oxygen shroud of box B of FIG. 2(*a*). The resulting cell lining and cathodic coating selection procedure is outlined in FIG. 2(*b*).

As represented in FIG. 2(*b*) by the box labeled F, the first criterion for selection of protective surface layer materials for molten salt electrolytic cell cathodes and cell linings according to this invention is that the candidate material must not be substantially reduced by the elemental metal product at the operating conditions of the cell. The second criterion represented by boxes G and H, is that the material must not substantially react with the electrolyte of the cell to form materials that are reactive with the elemental metal product at the operating conditions of the cell. If a candidate material is not reactive with the electrolyte, as shown in box G, it satisfies the second criterion. Additionally, even if the material is reactive with the electrolyte, if the reaction product is not reactive with the elemental metal product, the material will also satisfy the second criterion. This is represented by box H. The third criterion, represented by box I, is that the electrochemical potential of the material must be more electro-negative than that of the compound being electrolyzed in the cell to make metal product, thereby preventing the protective surface layer material from decomposing by electrolysis.

Although it is not the case with the wettable oxides described herein, if other materials are selected for use as the cathode, it is preferable that they be easily wetted by the molten metal product. This will reduce the liklihood of contact between the cathode and the electrolyte even in the absence of a deep molten product pool.

Although the specific compounds for which data are presented above are all inorganic metallic oxides, any compound can be employed that satisfies the criteria of this invention and (a) can, for electrodes, be provided as a thin coating upon a surface or has a low electrical resistance; or (b) can, for liners, be deposited or formed to insulate and prevent polarization of any conductive material thereunder. Electrodes and cell linings can be formed from pure metals and metal alloys on which protective films are generated, in situ, during operation of the electrolytic cells, or preferably, the protective layers can be generated ex situ prior to cell operation. For example, in the latter instance, an oxide film can be produced on a metal anode by electrolytic anodization at room temperature in a citric acid solution. This is not intended to be limiting, however, as the art is rich with methods for forming oxides on metals. An example of a suitable metal is zirconium and examples of metal alloys are zirconium-copper and zirconium-hafnium alloys. For liners, the protective layer may also be formed on a non-metallic and/or non-conductive base.

The oxide materials disclosed herein as electrode and cell lining coatings are typically electrical insulators, i.e., high bandgap materials. Thus, they must be present as a relatively thin layer if they are to be used upon the electrodes of molten salt electrolysis cells. Otherwise, they will impart too great an electrical resistance on the electrodes, greatly increasing the amount of electricity needed to operate the cell. An effective electrode can be achieved by making an electronically conductive portion, i.e., one with a low bandgap, upon which is formed or deposited the electrode coating material disclosed herein. The electronically conductive portion can be a metal, metal alloy, electronically conductive inorganic compound or solid solution. In one preferred embodiment, an electrode made in accordance with this invention can have a multi-layer structure comprising: (1) a foundation of commodity material formed into the bulk anode shape, (2) a first layer containing a metal, the oxide of which will satisfy the protective coating selection criteria, and (3) a second layer, covering the first layer and comprising a protective layer meeting the selection criteria. The second layer is preferably an oxide of a metal in the first layer. The foundation of the electrode is chosen from any of a variety of materials that are electrically conductive, inexpensive, and easily shaped to a desired anode configuration. Preferred foundation materials are copper, nickel, steel, or combinations thereof. An anode of this embodiment can comprise a copper or nickel foundation upon which a Zr metal layer is deposited. A $ZrO_2$ coating is then formed upon the Zr metal layer to form the protective layer. The protective layer must be kept as thin as possible to offer protection from chemical reaction of the anode with the electrolyte, while at the same time providing a minimum of increase in electrical resistance.

Alternatively, the foundation material can comprise an alloy of commodity material with a second metal, the oxide of which satisfies the selection criteria. When oxidized, such a structure will initially form a composition having oxides of both alloy metals. However, the commodity material oxide is consumed during the oxidation resulting in the desired protective layer of the second metal oxide. In order to minimize sharp composition differences in, for example, anode materials which can result in thermal mismatches leading to potential delamination, it is desirable to compositionally grade the initial alloy, with the alloy being richer in the second metal near the surface, with the percentage of the second metal being gradually reduced, perhaps to zero, when moving from the surface to the core.

The cathode can be constructed similarly; however, it need not be of the same specific construction as the anode. Rather, as long as its surface in contact with the electrolyte and/or the metal product satisfies the previously set forth criteria, it will be operable in the cell.

In still another embodiment, the separate electrode foundation material can be eliminated entirely. Thus, for example, an electrode formed of a metal whose oxide satisfies the selection criteria can serve as the electrode foundation. A protective layer of, for example, the metal's oxide is formed as a layer upon the metal resulting in an electrode having a single, protective layer. This construction is particularly desirable for an anode configuration that comprises a series of thin plates suspended vertically in the electrolyte.

It should be apparent that the above are merely examples of the wide variety of electrode configurations that can be constructed in accordance with the invention. Thus, rather than being limiting, the examples are intended to be merely representative of electrodes having a protective surface or layer satisfying the previously described selection criteria formed upon a layer of material that oxidizes to produce a material that satisfies the selection criteria for a protective layer. Such structures result in a coating that is self-healing upon fracture or other damage.

The protective surface layer material employed for the anode should also be resistant to additional oxidation since oxygen is generated at the anode. Thus, the protective surface layer material employed on the anode is preferably an oxy-compound with the particularly preferred materials being oxides.

Although similar in some aspects to the electrode configuration, the construction of cell linings in accordance with this invention presents a different set of considerations. In prior art electrolytic production cells such as Hall-Heroult cells, it is necessary to allow a layer of frozen electrolyte to form upon the surface of the cell lining. This frozen layer serves to protect the cell walls from the molten electrolyte, which if allowed to come into contact with the lining would cause it to be consumed. Unfortunately, the need to have molten electrolyte in the cell interior and frozen electrolyte at the cell walls necessitates a large thermal gradient which results in substantial energy losses.

These losses can be drastically reduced by providing a cell lining that directly contacts molten electrolyte. Such a cell lining can be obtained by the use of materials that meet the criteria for a protective layer set forth previously. Furthermore, to prevent it from acting as an electrode, the lining must not conduct electricity across the interface with the cell bath. Thus, it is not necessary to limit the thickness of the protective layer. For the case of Hall-Heroult cell, the lining can be formed of a foundation material upon which a relatively thick layer (e.g. approximately 1 mm) of a protective material such as $ZrO_2$, $HfO_2$, $ThO_2$ or $UO_2$ is formed. If the foundation material is a metal such as copper or steel, or some other conducting material, the layer should be thick enough to prevent electrical polarization of the cell lining. The protective layer can, however, be formed upon substantially any material whether conductive or nonconductive, that can maintain structural stability at the operating conditions of the cell. In the alternative, the lining can be formed of a monolithic block of a material that satisfies the selection criteria set forth previously.

It is not necessary that the same material be employed as the protective layer for both electrodes and/or the cell lining as long as all materials meet the criteria described herein. If the materials are not the same, it is desirable to saturate the electrolyte with all materials so that none are consumed during operation of the cell. It is preferred, however, to employ the same material for the electrodes and cell lining in most cases to minimize the reduction of aluminum oxide solubility in the electrolyte.

Figure 3:
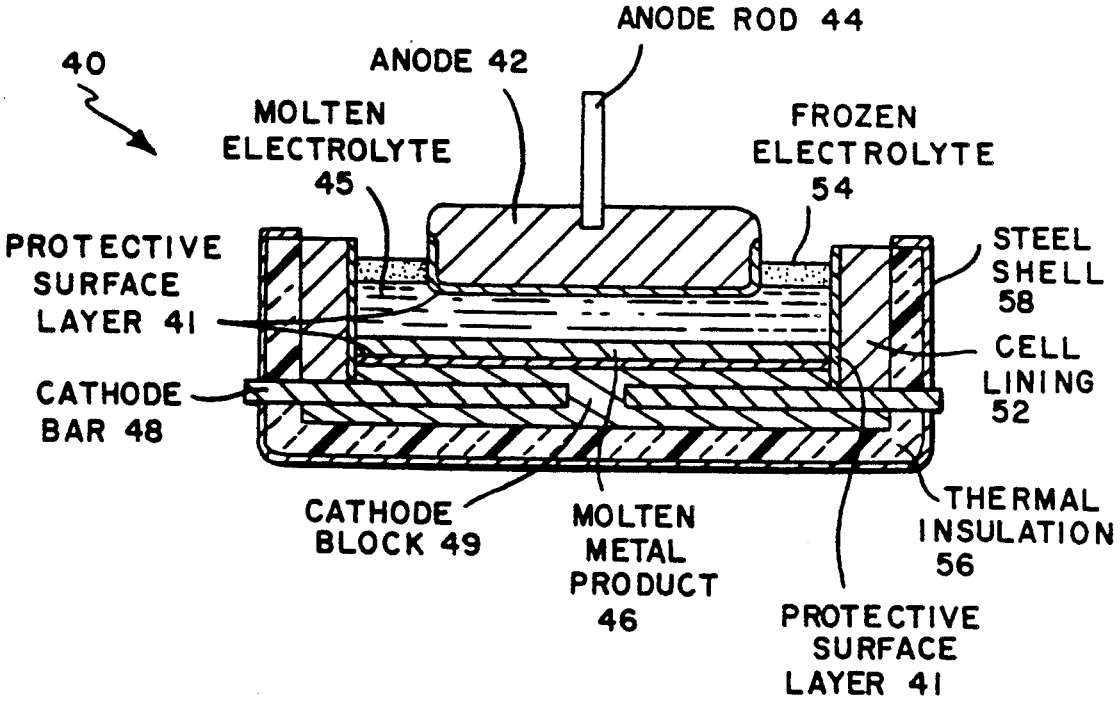
FIG. 3 is a schematic illustration of one embodiment of a Hall-Heroult cell modified according to this invention.

The use of materials satisfying the criteria described herein opens up new possibilities for the design of molten salt electrolytic cells. One such design, employing a horizontal monopolar anode, is schematically illustrated in FIG. 3. Electrolytic cell 40 has a steel outer shell 58 with thermal insulation 56 on the inside of shell 58 and contains a single anode 42 at the top of cell 40. A protective surface layer 41 is present on the surface of the anode 42 at all surfaces of the anode which contact the molten electrolyte 45. Anode 42 is connected to a supply of electric current by anode rod 44. Molten aluminum 46 is produced on the top surface of the cathode located at the bottom of the cell. The cathode can be formed from a collector bar 48 embedded in a cathode block 49 which can be formed to have the same protective material layer 41 as the anode.

Cell 40 also has cell lining 52 having a protective surface layer 41 of the same material as the protective surface layer 41 on anode 42 or cathode block 49 or from a different material satisfying the criteria discussed above. In the operation of cell 40, it is not necessary to employ cool side walls to create a frozen layer of electrolyte. Thus, molten electrolyte extends to cell lining 52 and the only frozen electrolyte is the layer 54 formed on top of the cell.

In the case in which the cell lining 52 is formed of a material having a surface that does not meet the electrode selection criteria, the cell lining will also be covered with frozen electrolyte 54.

Figure 4:
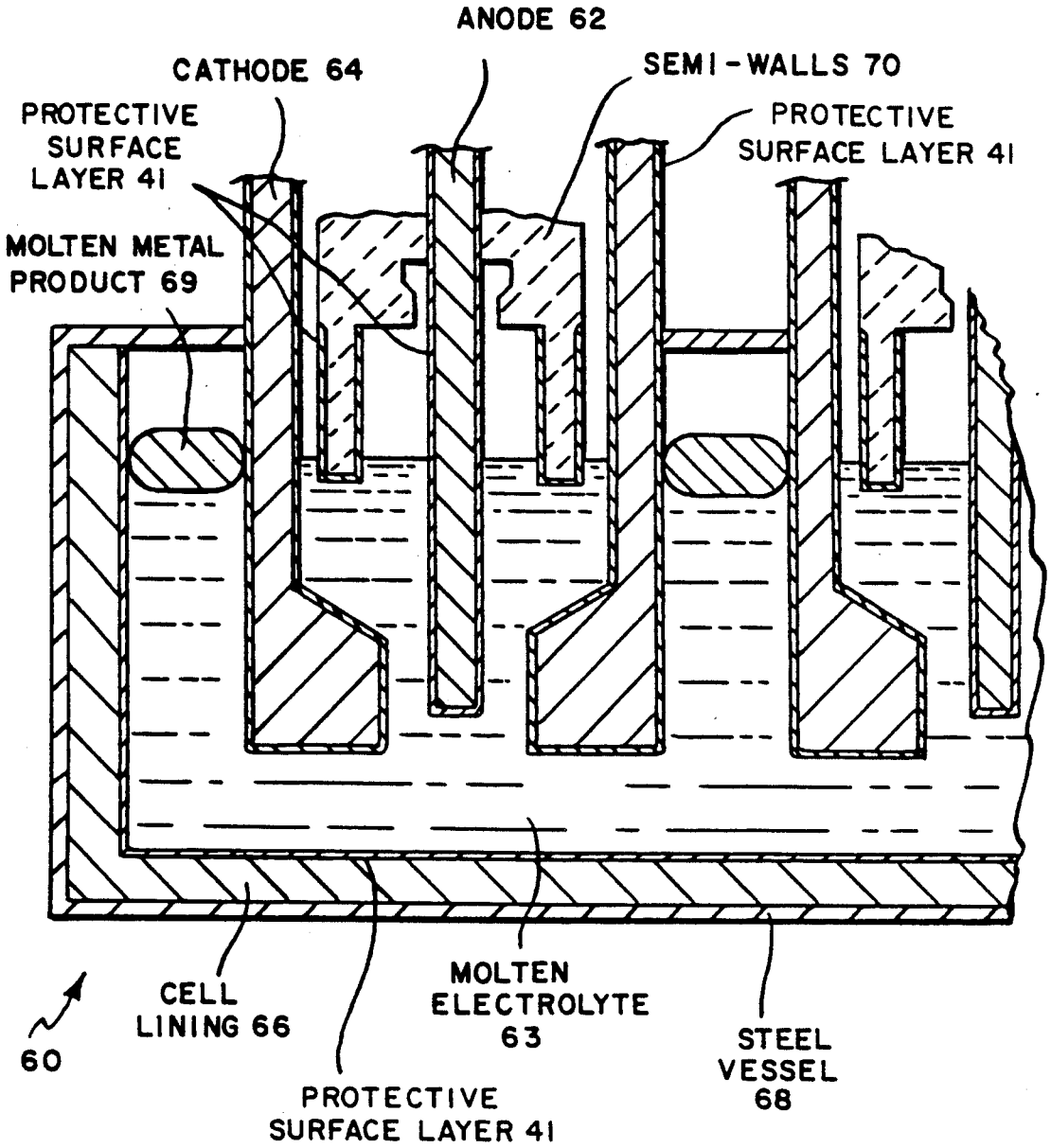
FIG. 4 is a schematic illustration of one embodiment of a vertical electrolytic reduction cell suitable for production of metals according to this invention.

Another design for a molten salt electrolytic cell employing materials meeting the criteria as described herein for the electrodes and cell lining is schematically illustrated in FIG. 4. Cell 60 has a series of vertically oriented anodes 62 formed having a protective surface from a material according to this invention. Cell 60 also contains a plurality of vertically oriented cathodes 64 which are preferably also formed in accordance with the teachings of this invention.

Cell lining 66, which is enclosed within a steel outer vessel 68, is formed having the same protective surface layer material that is employed for the protective surface of anodes 62 or from a different material meeting the cell lining criteria discussed herein.

In cases where the presence of saturation values of anode and cell lining materials does not alter the relative density of liquid metal product in molten electrolyte 63 from that of present electrolytic reduction cells, oxygen gas produced at anodes 62 rises to the melt surface and liquid metal product 69 falls to the bottom of cell 60. In cases where the relative density of liquid metal product and molten electrolyte 63 is inverted from the value in a present cell, both the oxygen gas and liquid metal product rise to the melt surface. Under these conditions, it is desirable to interpose a retaining structure or semi-wall 70 between anodes 62 and cathodes 64 to prevent the buoyant liquid metal product from forming an electrical short between electrodes. The choice of material for semi-wall 70 is subject to the same considerations as the choice of material for lining 66. In order not to reduce the ability of the electrolyte to dissolve the oxide-based feed material, semi-wall 70 and lining 66 should preferably consist of the same material.

Figure 5:
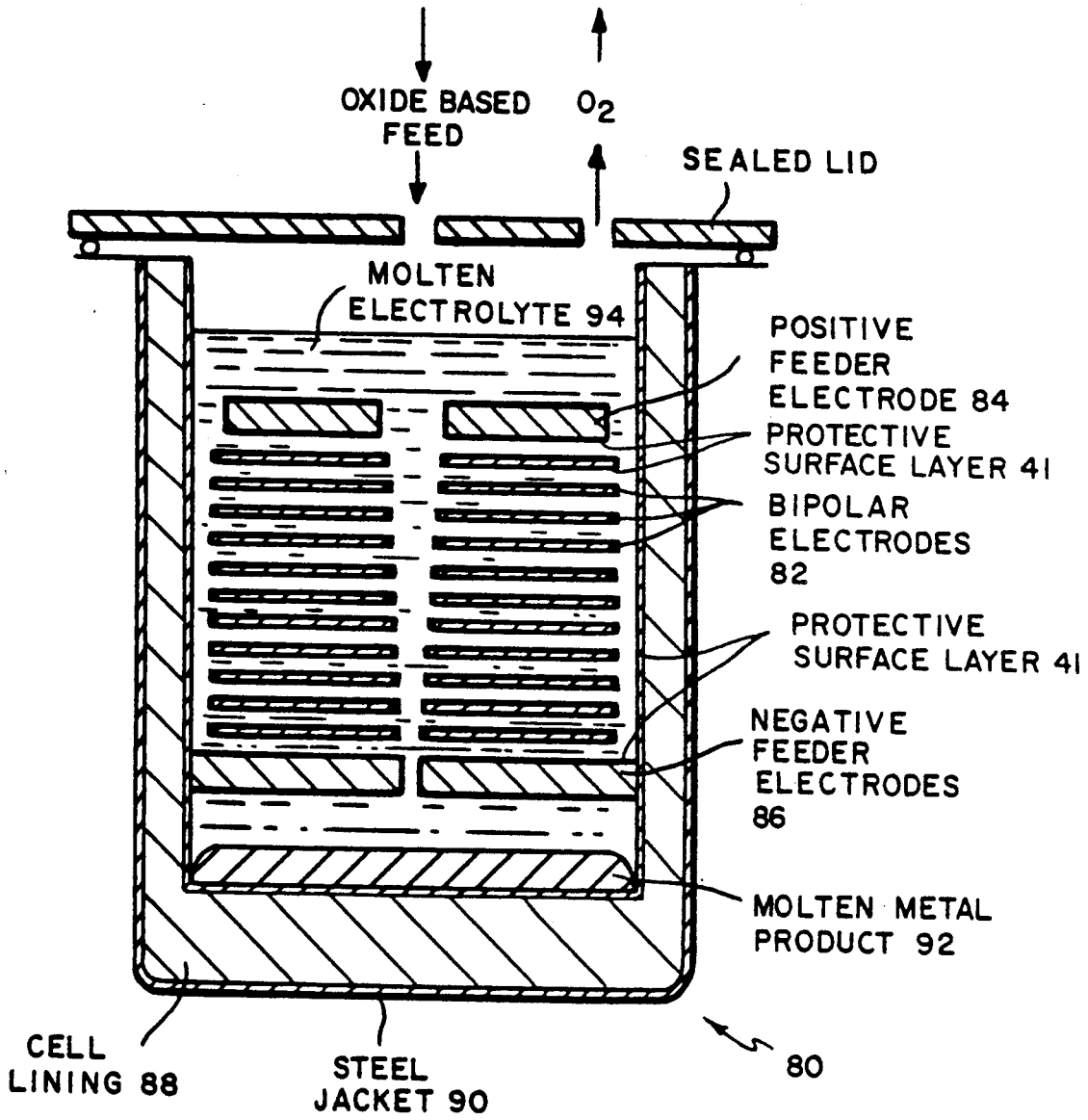
FIG. 5 is a schematic illustration of one embodiment of an electrolytic cell having bipolar electrodes suitable for the production of metals according to this invention.

Still yet another design for a molten bath electrolytic cell is schematically illustrated in FIG. 5. Cell 80 includes a horizontal bipolar electrode stack 82. In such a design, each electrode element consists of an anodic surface and a cathodic surface having a protective surface layer and separated from neighboring elements by electrically insulating spacers. A positive feeder electrode 84 and negative feeder electrode 86 are placed on the top and bottom of stack 82, respectively. Electrode elements have a protective surface layer formed from the materials described herein for protecting anodes and, preferably cathodes. Cell lining 88, enclosed in steel jacket 90, can be selected to have the same protective material as the anode protective layer, a different material meeting cell lining criteria or a more conventional material. If liquid metal product 92 is denser than the molten electrolyte 94, the bipolar stack is charged to make the upper surface of each element cathodic and the lower surface anodic. By providing a central vent, enhanced circulation of the electrolyte can be achieved as a consequence of the gas lift. If the liquid metal product is less dense in the electrolyte, a vertical bipolar arrangement is preferred. In this case, both the liquid metal product and oxygen gas rise to the melt surface. In this case it is necessary to introduce a retaining structure or semi-wall to prevent the liquid metal product from shorting the cathode to the anode.

Figure 6:
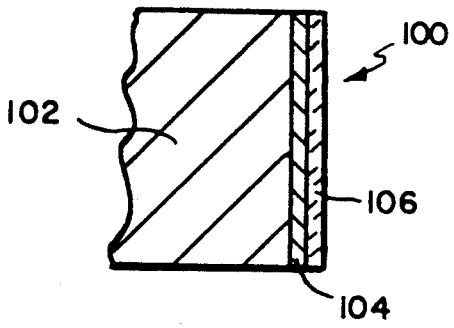
FIG. 6 is a schematic cross sectional illustration of one embodiment of a protective surface layer on an electrode according to this invention.

A cross sectional view of one embodiment of an electrode surface is represented schematically in FIG. 6. In this embodiment, the electrode 100, has a base 102, a metal layer 104 and an oxide layer 106. The base 102 is chosen to be electrically conductive, the metal layer is chosen to be a material, the oxide of which satisfies the selection criteria previously set forth, and the oxide layer forming a protective surface layer satisfying the criteria previously set forth.

Although the discussion above has largely been limited to electrolytic cells and methods for producing aluminum metal from molten salts, the materials described herein can also be employed in such cells and methods for producing other metals. For example, the criteria employed herein to select protective materials for the electrodes and cell linings of aluminum cells can also be applied to select protective materials suitable for the production of magnesium, neodymium or other metals from oxide based feed material. In these cases, the material selected must meet the same criteria adapted for the specific metal to be produced rather than for aluminum. Thus, the first criterion is that the material must not be reduced by the metal to be produced under the operating conditions of the cell. The second criterion is that the material must not be attacked by salts of the metal contained in the cell to form materials that are reactive with the elemental metal. The third criterion is that the electrochemical potential of the material be more electronegative than the compound undergoing electrolysis in the metal production cell.

The invention will now be more particularly pointed out in the examples below.

EXAMPLES

Example 1

Exposure of Anodized Zr to Cell Operating Conditions

An alumina ($Al_2O_3$) crucible was heated to approximately 1200 K. The crucible contained a molten electrolyte layer which entirely covered a molten aluminum pool at the bottom of the crucible. The electrolyte comprised 4.5 g of aluminum oxide, $Al_2O_3$; 30.252 g cryolite, $Na_3AlF_6$; 3.916 g of aluminum fluoride, $AlF_3$; and 1.428 g of calcium fluoride, $CaF_2$. This represented a bath composition of 75.63 wt. % $Na_3AlF_6$; 9.79 wt. % $AlF_3$; 3.57 wt. % $CaF_2$ and $Al_2O_3$ in excess of saturation (approximately 11 wt. %).

A zirconium rod having $ZrO_2$ coating produced by anodization at 200 volts in citric acid was lowered into the crucible so as to be immersed in molten electrolyte and molten aluminum. This cell configuration was maintained for approximately 4 hours.

The zirconium rod was subsequently removed from the crucible and examined. The anodized surface and underlying metal did not appear to have been attacked or removed by contact with the molten cryolite or the molten aluminum. This demonstrated that Zr having $ZrO_2$ coating in all regions which contact the electrolyte and the metal pool may be suitable for use as a sidewall in aluminum reduction cells. As the Zr was not energized, the results of this example cannot be directly applied to an evaluation of anodized Zr as an anode material or as a cathode material in aluminum reduction cells.

EXAMPLE 2

Aluminum Deposition Using $ZrO_2$ Anode

Electrolysis of aluminum was conducted in a laboratory-scale cell of the following design. The anode was zirconium metal in the shape of a rod having a diameter of about 0.25 in. The zirconium had previously been anodized in an aqueous solution of ciric acid at an applied voltage of approximately 200 V. This anodization process resulted in the formation of a thin film of zirconium oxide, $ZrO_2$, on the surface of the zirconium metal.

The electrolyte comprised 4.5 g of aluminum oxide, $Al_2O_3$; 30.252 g cryolite, $Na_3Alf_6$; 3.916 g of aluminum fluoride, $AlF_3$; and 1.428 g of calcium fluoride, $CaF_2$. This represented a bath composition of 75.63 wt. % $Na_3AlF_6$; 9.79 wt. % $AlF_3$; 3.57 wt. % $CaF_2$, and $Al_2O_3$ in excess of saturation (approximately 11 wt. %). The melt was contained in a nickel crucible which served as the cathode.

Electrolysis was conducted for approximately 5 hours at a cell temperature of approximately 970° C. The cell current was approximately 400 mA and the cell voltage was measured to be approximately 6 V. These conditions resulted in the deposition of aluminum metal on the nickel crucible. Some alloying with the nickel cathode was observed. The presence of aluminum was confirmed by energy dispersive spectroscopy using a scanning electron microscope. The anode remained intact and showed no evidence of dissolution. These results demonstrate that $ZrO_2$ satisfies the selection criteria and that $ZrO_2$ on a Zr metal monolith can be used successfully as an anode in aluminum reduction cells.

EXAMPLE 3

Aluminum Deposition Using $HfO_2$ Anode

Electrolysis of aluminum was conducted in a laboratory-scale çell of a design similar to that of the previous example. However, in this example, the anode was a rod of hafnium metal having a diameter of about 0.125 in. This metal electrode had previously been subjected to anodization in an aqueous solution of citric acid at an applied voltage of approximately 40 V. This anodization process resulted in the formation of a thin film of hafnium oxide, $HfO_2$, on the surface of the hafnium metal.

The electrolyte comprised 4.5 g of aluminum oxide, $Al_2O_3$, 30.252 g cryolite, $Na_3AlF_6$; 3.916 g of aluminum fluoride, $AlF_3$; and 1.428 g of calcium fluoride, $CaF_2$. This represented a bath composition of 75.63 wt. % $Na_3AlF_6$, 9.79 wt. % $AlF_3$; 3.57 wt. % $CaF_2$, and $Al_2O_3$ in excess of saturation (approximately 11 wt. %). The melt was contained in a nickel crucible which served as the cathode.

Electrolysis was conducted for approximately 3 hours at a temperature of about 960° C. The total current was maintained at approximately 150 mA and the cell voltage was measured at approximately 8 V. These conditions resulted in the production of aluminum metal at the nickel cathode where it alloyed with the solid metal of the cathode. The presence of aluminum was confirmed by energy dispersive spectroscopy using a scanning electron microscope. The anode remained intact and showed no evidence of dissolution. These results demostrate that $HfO_2$ satisfies the selection criteria and that $HfO_2$ on Hf metal can be used successfully as an anode in aluminum production cells.

EQUIVALENTS

Those skilled in the art will recognize or be able to ascertain, using no more than routine experimentation, many equivalents to the specific embodiments of the invention described herein. Such equivalents are intended to be covered by the following appended claims.

What is claimed is:

1. An electrode for use in an electrolytic cell for the production of a metal product by the electrochemical reduction of an oxide based feed material dissolved in a molten electrolyte, wherein the electrode consists of a metal or metallic alloy foundation and further wherein all surfaces of the electrode that contact the electrolyte comprise a protective layer formed upon an oxidizable material, said oxidizable material being such that it forms an oxide product upon its surface when such surface is contacted with the electrolyte, the electrode being such that, at the operating conditions of the cell the protective layer and oxide product:

a. are not substantially reduced by the metal product;

b. are not substantially reactive with the electrolyte to form a material that is reactive with the metal product; and, c. have an electrochemical potential that is more electronegative than that of the feed material undergoing electrolysis to produce the metal product of the cell.

2. An electrode as in claim 1 wherein the electrolytic cell is an aluminum reduction cell.

3. An electrode as in claim 1 wherein said electrode is an anode.

4. An electrode as in claim 1 wherein the protective layer is formed upon the oxidizable material prior to introduction of the electrode into the electrolytic cell.

5. An electrode as in claim 1 wherein said protective layer is formed upon an alloy of a foundation metal and the oxidizable metal, said alloy being compositionally graded to be richer in the oxidizable metal near surfaces upon which the protective layer is present.

6. An electrode as in claim 1 wherein the oxidizable material is in the form of a layer formed upon the surface of the foundation.

7. An electrode as in claim 6 wherein the foundation is a metal selected from the group consisting of copper, nickel, steel or combinations thereof.

8. An electrode as in claim 1 wherein the protective layer and the oxide product comprise the same material.

9. A cell lining for use in an electrolytic cell for the production of a metal product from an oxide based feed material, said lining having all surfaces that contact a molten electrolyte contained within the cell being substantially electrically nonconductive and being formed of a material that, at the operating conditions of the cell:

(a) is not substantially reduced by the metal product;

(b) is not substantially reactive with the electrolyte to form a material that is reactive with the metal product; and, (c) has an electrochemical potential that is more electronegative than that of the feed material undergoing electrolysis to produce the metal product.

10. A cell lining as in claim 9 wherein the electrolytic cell is an aluminum reduction cell.

11. A lining as claimed in claim 9 wherein said lining includes a foundation and a protective layer of the material upon all surface of the foundation facing the molten electrolyte.

12. A lining as claimed in claim 11 wherein said foundation is of a conductive material, and wherein said protective layer is of a thickness sufficient to prevent electrical polarization of said conductive material.

13. An electrolytic cell for the production of a metal product by the electrolytic reduction of an oxide based feed material dissolved in a molten electrolyte, said cell comprising a vessel for containing the molten electrolyte, a vessel lining in contact with the electrolyte, an anode and a cathode, wherein the anode consists of a metal or metallic alloy foundation having a protective layer formed upon an oxidizable material, said oxidizable material being such that it forms an oxide product upon its surface when such surface is contacted with the electrolyte, the electrode being such that, at the operating conditions of the cell the protective layer and oxide product:

a. are not substantially reduced by the metal product;
b. are not substantially reactive with the electrolyte to form a material that is reactive with the metal product; and,
c. have an electrochemical potential that is more electronegative than that of the feed material undergoing electrolysis to produce the metal product of the cell.

14. An electrolytic cell as in claim 13 which is an aluminum reduction cell.

15. An electrolytic cell as in claim 13 wherein the oxidizable material is in the form of a layer formed upon the surface of the foundation.

16. An electrolytic cell as in claim 15 wherein the foundation is a metal selected from the group consisting of copper, nickel, steel or combinations thereof.

17. An electrolytic cell as in claim 13 wherein the vessel lining is in direct contact with the molten electrolyte.

18. An electrolytic cell as in claim 17 wherein the vessel lining has all surfaces in direct contact with the molten electrolyte, formed of a material that, at the operating conditions of the cell:

(a) is not substantially reduced by the metal product;
(b) is not substantially reactive with the electrolyte to form a material that is reactive with the metal product; and,
(c) has an electrochemical potential that is more electronegative than that of the feed material undergoing electrolysis to produce the metal product of the cell.

19. An electrolytic cell as in claim 18 wherein said surfaces in direct contact with the molten electrolyte comprise a vessel lining protective layer, the vessel lining protective layer being formed of the same material as the protective layer upon the anode.

20. An electrolytic cell as claimed in claim 18 including a semi-wall disposed between an anode and cathode electrode, said semi-wall having at least all surfaces in contact with molton electrolyte formed of said material.

21. An electrolytic cell as in claim 13 wherein the protective layer is formed upon the anode prior to introduction of the anode into the electrolytic cell.

22. An electrolytic cell as in claim 13 wherein said electrolyte is saturated with the material forming said protective layer.

23. An electrolytic cell as in claim 22 wherein the vessel lining has a protective layer of said material on at least all surfaces in contact with electrolyte; and wherein said electrolyte is saturated with each said material forming a protective layer.

24. An electrolytic cell as in claim 13 wherein the protective layer and the oxide product comprise the same material.

25. An electrolytic cell for the production of a metal product by the electrolytic reduction of an oxide based feed material dissolved in a molten electrolyte, said cell comprising a vessel for containing the molten electrolyte, a vessel lining in contact with the electrolyte, at least one vertically oriented anode paired with at least one vertically oriented cathode, wherein at least one of the anode, the cathode; or the vessel lining consists of a metal or metallic alloy foundation having a protective layer formed upon an oxidizable material, said oxidizable material being such that it forms an oxide product upon its surface when such surface is contacted with the electrolyte, the electrode being such that at the operating conditions of the cell the protective layer and oxide product:

a. are not substantially reduced by the metal product;
b. are not substantially reactive with the electrolyte to form a material that is reactive with the metal product; and,
c. have an electrochemical potential that is more electronegative than that of the feed material undergoing electrolysis to produce the metal product of the cell.

26. An electrolytic cell as claimed in claim 25 including a vertically oriented semi-wall disposed between each pair of anodes and cathodes, said semi-wall having said protective layer on its surface.

27. An electrolytic cell as in claim 25 which is an aluminum reduction cell.

28. An electrolytic cell as in claim 25 wherein the protective layer and the oxide product comprise the same material.

29. An electrolytic cell for the production of a metal product by the electrolytic production of an oxide based feed material in a molten electrolyte, said cell comprising a vessel for containing the molten electrolyte, a vessel lining in contact with the electrolyte, and a horizontal bipolar electrode stack disposed between a positive feeder electrode and a negative feeder electrode, wherein at least one of the positive feeder electrode, the negative feeder electrode, the bipolar electrode stack or the vessel lining consists of a metal or metallic alloy foundation having a protective layer formed upon an oxidizable material, said oxidizable material being such that it forms an oxide product upon its surface when such surface is contacted with the electrolyte, the electrode being such that, at the operating conditions of the cell the protective layer and oxide product:

a. are not substantially reduced by the metal product;
b. are not substantially reactive with the electrolyte to form a material that is reactive with the metal product; and,
c. have an electrochemical potential that is more electronegative than that of the feed material undergoing electrolysis to produce the metal product of the cell.

30. An electrolytic cell as in claim 29 which is an aluminum reduction cell.

31. An electrolytic cell as in claim 29 wherein the protective layer and the oxide product comprise the same material.

* * * * *